United States Patent [19]

Ellzey

[11] 4,016,818

[45] Apr. 12, 1977

[54] MONORAIL SWITCH

[76] Inventor: Floyd P. Ellzey, 2301 Marshallfield Lane, Redondo Beach, Calif. 90278

[22] Filed: Sept. 2, 1975

[21] Appl. No.: 609,229

[52] U.S. Cl. ..... 104/103; 104/130

[51] Int. Cl.[2] ..... E01B 25/26

[58] Field of Search ..... 104/130, 131, 132, 89, 104/92, 95, 102, 103, 96; 246/44 B; 308/6 C, 29

[56] References Cited

UNITED STATES PATENTS

| | | | |
|---|---|---|---|
| 1,035,244 | 8/1912 | Sande | 104/103 |
| 1,286,042 | 11/1918 | McClure et al. | 104/130 |
| 3,063,574 | 11/1962 | Peterson | 308/6 C X |
| 3,791,306 | 2/1974 | Wagner et al. | 104/130 |

FOREIGN PATENTS OR APPLICATIONS

| | | | |
|---|---|---|---|
| 947,523 | 1/1964 | United Kingdom | 104/103 |

*Primary Examiner*—Frank E. Werner
*Assistant Examiner*—Randolph A. Reese

[57] ABSTRACT

A monorail track switch comprised of two swinging switch beams pivoted to track beam ends from which the wheeled trucks of trains are to be directed onto a continuing main line track beam, freedom for switch movements being provided for by anti-friction articulation of all members thereof, and characterized by a retractile gate that is replaceable between the free end faces of the two swinging switch beams respectively, and the opposed end face of the continuing main line track beam.

4 Claims, 11 Drawing Figures

SUPPORT
L
X
10
25
26
R
B
H
6
M1
45
C
M2
G
M
11
31
30
13
14
12
A

SUPPORT
L
R
10
X
B
13
44
30
M
7
11
25
3
M1
M2
14
12
31
26
A
C
G
H

H
M2
C
S
45
G
41-42
12
A
9
13
14
R
43

MONORAIL SWITCH

BACKGROUND

This invention relates to elevated monorail track wherein switching is to be accomplished for running the trucks of cars onto and off of a line of track. The cars are suspended from the trucks and the track is in the nature of a continuous beam that is interrupted by switch beams where lateral lines feed into or from a main line. The track beams are supported upon spaced columns or the like and are necessarily of weighty construction for rigidity, and correspondingly the switch beams too are of weighty construction. To these ends it has been difficult to construct switches that are reliable and quick operating, and heretofore such switches have been slow moving cumbersome structures. In this respect therefore, it is a general object of this invention to provide a fast moving switch for elevated monorail track. With the present invention the main line track and lateral track are connected and/or disconnected by articulated switch beams locked in selected position by a releasible gate, and all of which is conducive to rapid movement when released and reliably secure when locked.

A feature of elevated monorail systems is that the cars are suspended below the track beam from wheeled trucks that operate upon one or a pair of rail members. Consequently, the overhead area thereof is obstructed by beams and arches, and to this end it is an object of this invention to provide an articulated self-aligning overhead support means for the selectively positionable switch beams, while the rail members remain unobstructed for operation of the truck wheels therealong.

The track beams and switch beams are structural for sustaining the loads imposed by passing trains, and they are necessarily subjected to deflection thereby and as well due to earth movement; and to this end it is an object to provide releasible lock means that secures any one of a plurality of switch beams in alignment with a main line track beam and operable to separate said switch beams from the main line track beam for repositioning. In practice, the track and switch beams are of substantial transverse dimension, and being of rigid structure the abutment of the switch beams with the continuing main line track beams vary between right and left lateral switch beams and the main line switch beam. To this end therefore, I provide a retractile gate that shifts into and out of the plane of abutment between the live swinging ends of the switch beams and end of the continuing main line track beam. This gate is essentially a key member that is removable for freedom of the switch beams and replaceable for track continuity.

It is an object of this invention to provide anti-friction support for the articulation of switch beams in an elevated monorail track system, and to this end swinging switch beams are employed with bearing spindles at their pivoted ends in alignment with main line and lateral track as the case may be, and with bearing ways at their swinging ends for positionable movement into and out of abutment with a continuing main line track. In practice, the bearing spindle employs roller bearings and the bearing ways for switch beam support and the aforementioned retractile gate employ recirculating ball bearings.

It is also an object of this invention to provide for quick activation of monorail switch beams, and to this end high speed electric motor operation is intermittently imposed as required to rapidly shift and/or reposition the switch beams and retractile gate, as circumstances require. In practice, separate actuator units are employed for switch beam and gate operation, the former programmed for operation intermediate the retraction and replacement operation of the latter. In practice, initial operation of the gate actuator to retract the same enables repositioning of one of the switch beams, followed by reverse operation of the gate actuator to replace the same for securement of the other switch beam in alignment with the main line track.

SUMMARY OF INVENTION

Elevated monorail track must be provided with switching conducive to economical train management, and to this end I have provided swinging switch beams that are releasable from the main line track for quick repositioning as and when required. The switch interrupts what will be referred to as a main line track, in order to enable entry and exit of trains onto and off of what will be referred to as a lateral track. Characteristically, the switch is comprised of swinging switch beams pivotally articulated from the terminal ends of main line and lateral track beams and each adapted to align with a continuing main line track beam. The swinging ends of the switch beams are suspended from a header by means of free moving carriages coupled thereto by ball and socket shackles. In practice, the track width of the wheeled trucks is substantial, and for this reason the track alignment and continuity thereof is perfected by the inclusion of a retractile gate that is replaceable by actuator means in order to release and provide clearance for selective movement of the two switch beams into and out of working position. The two switch beams are coupled by a ball and socket strut, and all to the end that there is a main line track interrupted by a switch providing access to a lateral or side track.

DRAWINGS

The various objects and features of this invention will be fully understood from the following detailed description of the typical preferred forms and applications thereof, throughout which description reference is made to the accompanying drawings, in which.

PREFERRED EMBODIMENT

Figure 1:
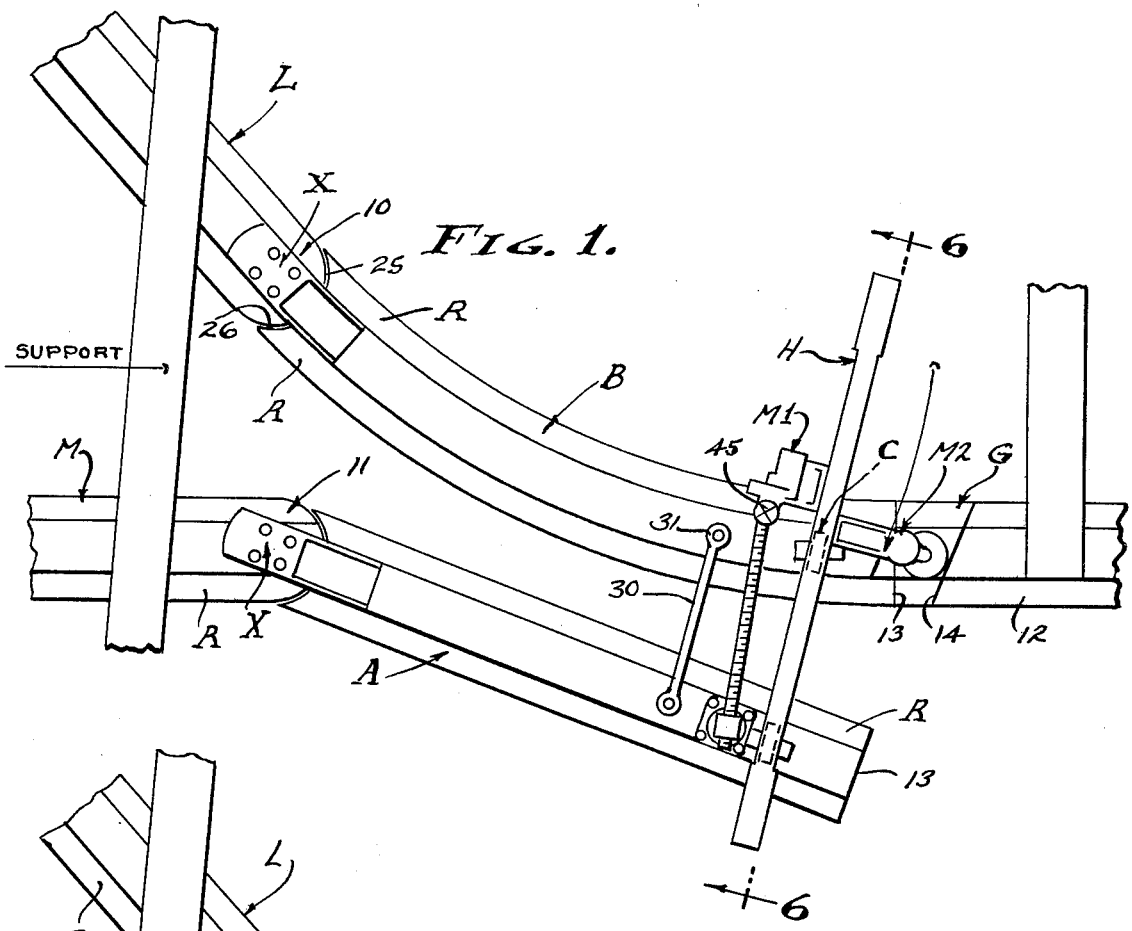
FIG. 1 is a plan view of the monorail switch, showing the lateral track switch beam in alignment with the continuing main line track beam.

Referring now to the drawings, there is a main line track M interrupted by a switch opening, and there is a lateral or side track L extending to said switch opening where it terminates for interconnection with said main line track. In practice, the approach of the lateral track L to the main line track M is at an acute angle where the terminus end 10 thereof occurs, terminating at what will be referred to as the main track end 11. Accordingly, the main line track continues in what will be referred to as a continuing track 12. In accordance with this invention, switch beams A and B extend from the track end 11 and terminus end 10, respectively, to which they are pivoted by anti-friction bearing means X, there being a gate G retractable from between the swinging ends of the switch beams A or B and the end of continuing track 12. The two switch beams A and B are suspended from carriages C, respectively, operable along a transverse header H to carry the switch beams into and out of alignment with the continuing main line track 12. A coupling in the form of a link with ball joint connection to each switch beam extends therebetween with freedom to articulate. In carrying out this invention, the carriages C and gate G move upon anti-friction recirculating bearings, and suspension means S is provided with ball joints to couple the switch beams to the carriages therefor with freedom to articulate.

The track involves beam sections of uniform cross section having upper and lower horizontally disposed caps 15 and 16 held spaced and parallel by a vertically disposed web 17. As shown, the track beams are box sections with opposite side webs 17 held spaced by longitudinally spaced bulkheads 18, and through which conduits and various other facilities can extend as circumstances require. Projecting laterally from the lower side of the track there is a pair of rails R presenting upwardly disposed surfaces upon which the wheels of trucks may roll. The rails R have camber with respect to each other and disposed at a common plane of support, all of which is practiced in the application of rolling stock which involve wheeled trucks and gondolas and/or train bodies suspended therefrom as illustrated in the drawings.

Figure 2:
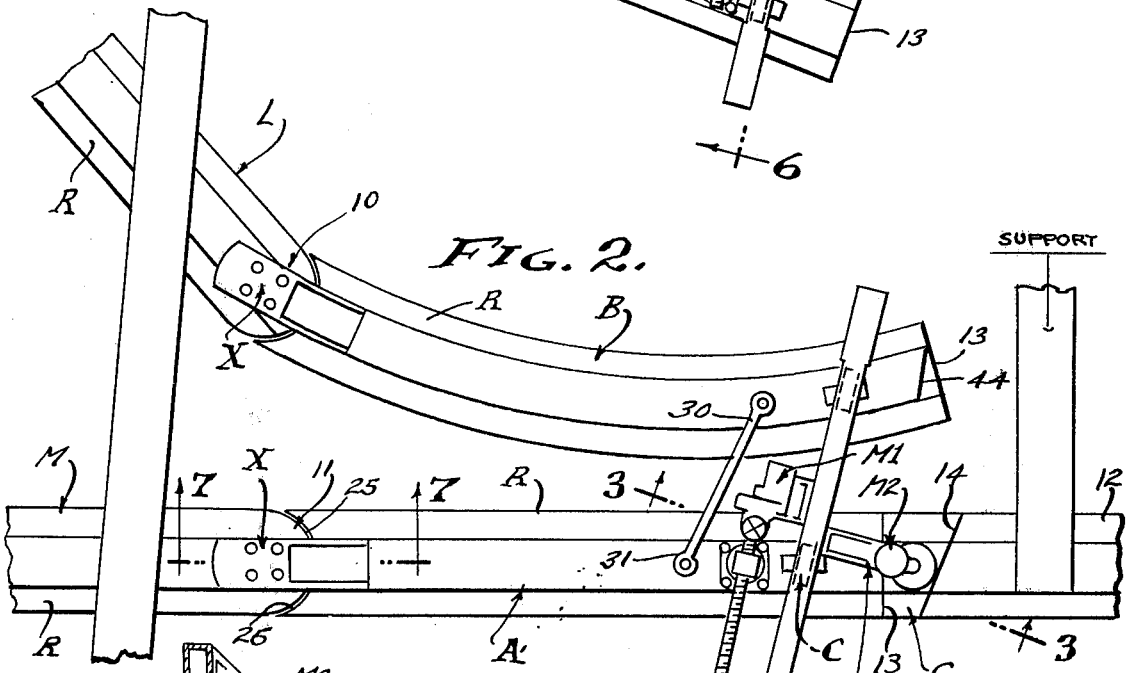
FIG. 2 is a view similar to FIG. 1 showing the main line switch beam in alignment with the continuing main line track beam.
Figure 3:
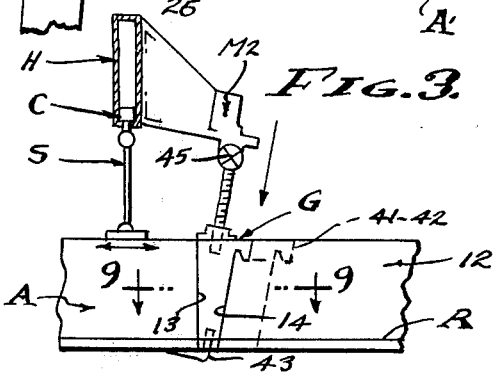
FIG. 3 is a sectional view taken as indicated by line 3—3 on FIG. 2.
Figure 4:
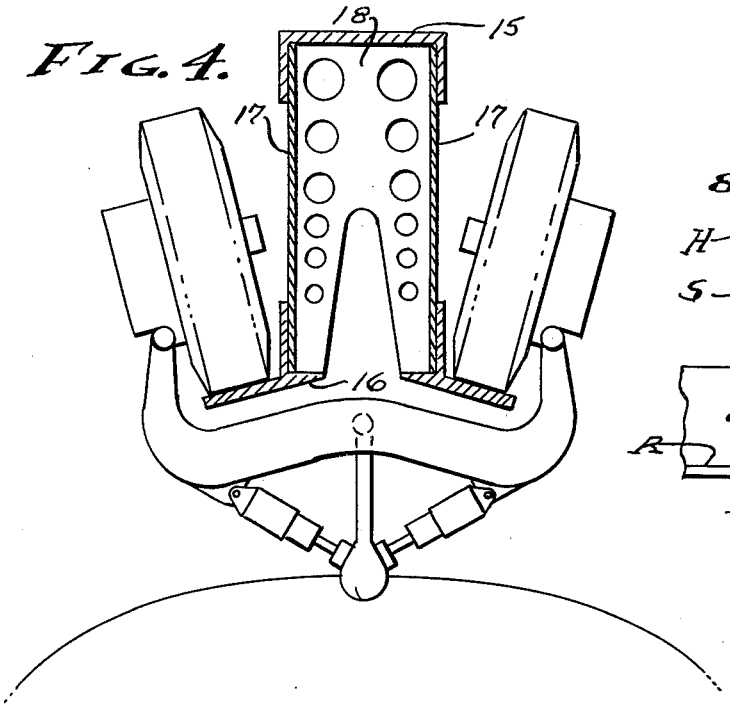
FIG. 4 is an enlarged transverse view illustrating the wheeled support of a truck upon the rails of a track beam.
Figure 5:
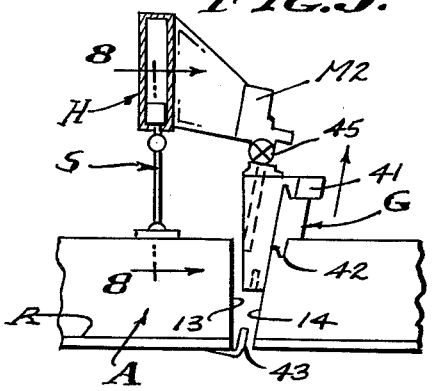
FIG. 5 is a view similar to FIG. 3 illustrating retraction of the gate which characterizes this invention.
Figure 6:
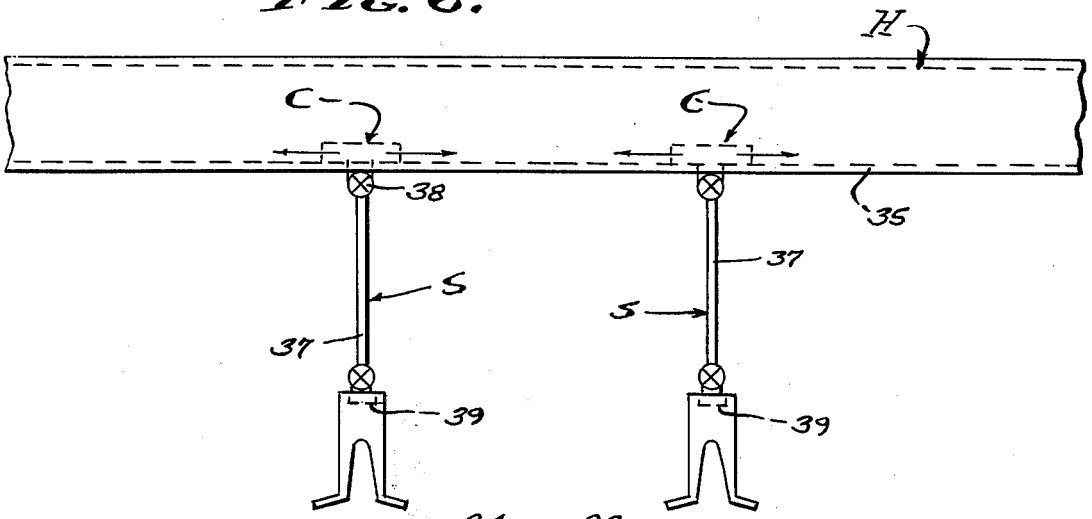
FIG. 6 is a side elevation of the header, illustrating suspension of the switch beams.

Referring now to FIGS. 1 and 2 of the drawings, the switch is comprised of articulated track beams that are selectively positioned between the terminal ends 10 and 11 of the two separate track beams and a continuing track beam 12. For purposes of illustration, the main line track 11–12 is shown straight, and typically the lateral track beam approaches the terminus 10 thereof at an acute angle. Switch beams A and B are rigid track beams, dissimilar with respect to the direction in which they extend. As shown, the main line switch beam A is a straight member with one end pivotally secured to the end 11 spaced from the end of continuing track 12 and with its other end spaced from the track end at 12 to which it is opposed. The lateral line switch beam B is an arcuate member, in plan view, with one end pivotally secured to the end 10 laterally spaced from the end 11 and with its other end spaced from the track end at 12 to which it is opposed. It is significant that the swinging end faces 13 of the two switch beams are spaced from the fixed end face 14 of the continuing track 12, said end faces 13 and 14 being normal to the switch beam ends in each instance and opposed to end face 14 of the continuing track 12. The said end face 14 is angularly truncated to normally oppose, in plan view, the pivotal connection of switch beam B to the terminus 10 of the lateral track; thereby providing swinging clearance for the transverse shifting of said switch beam.

Figure 7:
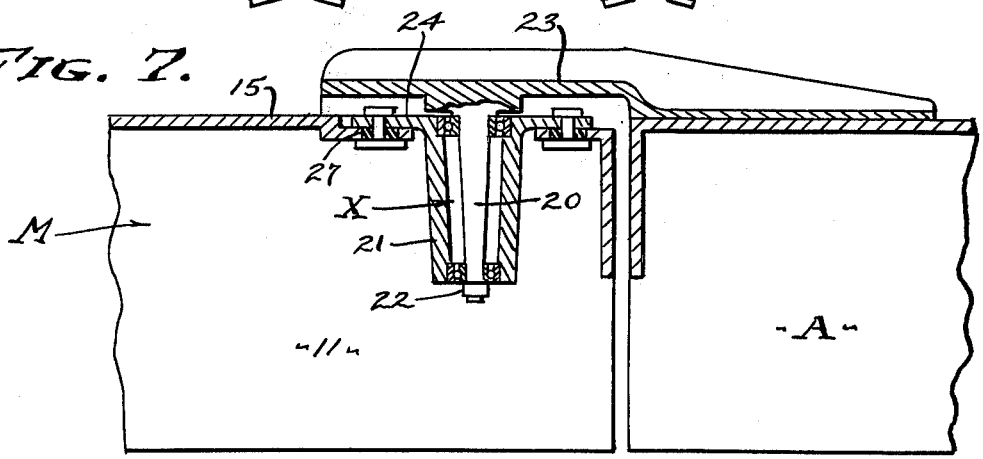
FIG. 7 is an enlarged sectional view taken as indicated by line 7—7 on FIG. 2.

Both switch beams A and B are pivotally mounted to the track ends at 11 and 10 by anti-friction bearing means X, each comprised of a spindle 20 depending from one beam member preferably the switch beam, and into a sleeve 21 in the other beam member preferably the terminating track beam. As shown in FIG. 7, the spindle 20 is tapered with larger and smaller tapered roller bearings at the upper and lower extremities thereof, seated in the usual manner and secured by a nut 22. The spindle 20 depends from an arm 23 extending from the one beam to overlie the end portion of the other beam. In practice, the sleeve 21 is secured in position by a shiftable plate 24 cap screwed to the upper cap 15 of the track beam through resilient bushings 27. The opposed end faces 25 and 26 of the beams are complementary and closely juxtapositioned arcuate faces formed above the spindle center of rotation.

Figure 11:
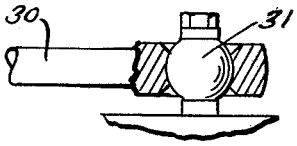

In accordance with this inventon, the terminus 10 of the lateral track is displaced from the main track a distance sufficient for the passage of a truck thereby, and accordingly substantially the same distance is maintained coextensively of switch beams A and B by the aforementioned link of the coupling or strut 30. As shown, the strut 30 extends between the upper caps 15 of the two beams and is secured thereto by ball and socket joints 31 (see FIG. 11). Consequently, the two switch beams move or shift together and remain uniformly spaced by the said strut, and always free from binding that could be caused by deflections and misalignments.

Figure 8:
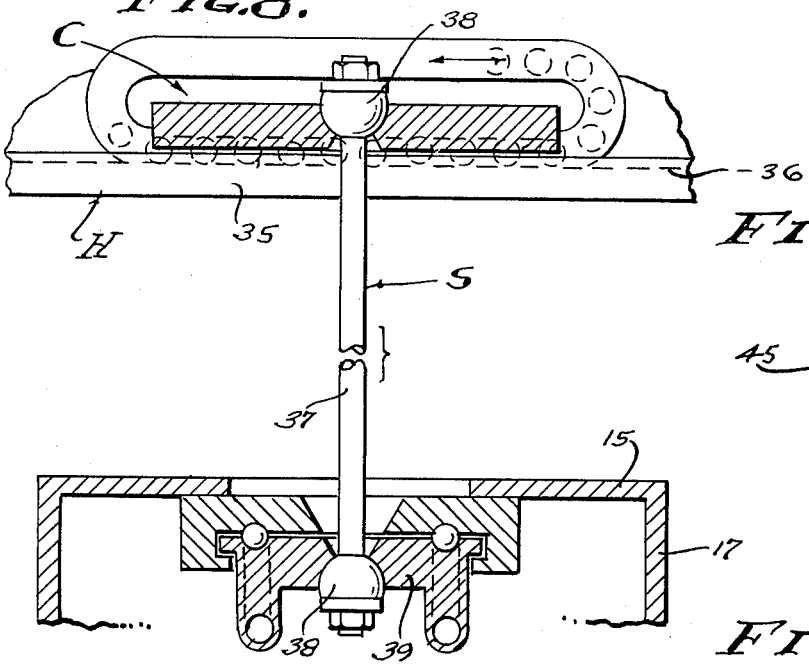
FIG. 8 is an enlarged detailed fragmentary view taken as indicated by line 8—8 on FIG. 5.

A characteristic feature of this invention is the carriage of the swich beams A and B from the header H by the suspension means S. The header H is a straight beam transversely disposed over the active swinging end portions of the two switch beams A and B, with the opposite end portions thereof positioned to overlie the extreme displaced positions of the said beam end portions respectively. Like the main line and lateral track beams, the header H is supported by columns or the equivalent supporting structure in the manner commonly practiced in the art. As shown, the header H is a beam of box cross section with its lower cap 35 coextensively slotted to present a pair of spaced upwardly disposed ways 36. A pair of carriages C operate independently upon the ways through recirculating bearings (see FIG. 8) that roll thereon, one carriage to support each switch beam A and B through the suspension shackle 37 therefor. There is a shackle 37 for each switch beam and connected thereto and to the carriage in each instance by ball and socket joints 38 at its upper and lower terminal ends respectively (see FIG. 8). In practice, the shackles 37 depend vertically from the carriages C to the supported switch beam when the latter is in working position aligned with the continuing main line track 12. As shown, the box-beam header H is a straight member while the switch beams swing arcuately so as to displace a fixed point of suspension; and compensation for this is provided for in a slide 39 that works longitudinally of each switch beam through recirculating bearings (see FIG. 8), thereby permitting the shackles 37 to depend vertically at all times. Consequently, the working positions of the switch beams are not adversely affected by deflections and misalignments.

Figure 9:
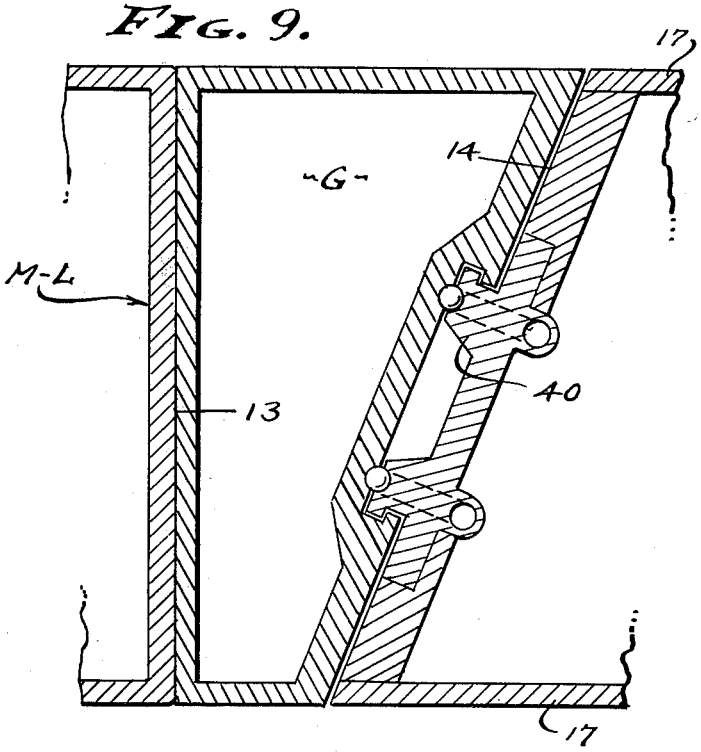
FIG. 9 is a enlarged fragmentary view taken as indicated by line 9—9 on FIG. 3. And, FIGS. 10 and 11 are enlarged detailed views of the universal joint and ball joint of the actuator drives and switch beam coupling link, respectively.

Another characteristic feature of this invention is the retractile gate G that normally occupies the space between the end faces 13 and 14 so as to complete continuity of the track and switch beams and namely of the rails thereof. Essentially, the gate G is a key member that establishes track continuity when in working position, and that permits switch beam movement when retracted. In accordance with this invention, the retraction is such as to increase clearance with a minimum of movement, and as shown by means of an upward and rearward departure from the switch beam end face 13. To this end, the face 14 is reclined upwardly and rearwardly away from the swinging beam end face 13 of both switch beams A or B. The gate has the same cap configuration 15 and 16 and web configuration 17 hereinabove described and has rails R, and all of which completes the track when in working position. Accordingly, the gate is captured to retract upwardly and rearwardly upon the plane of face 14, and to this end is secured to ways 40 on face 14 by recirculating bearings (see FIG. 9). Supported positioning of the gate G is by means of complementary interlocking members 41 and 42 on the upper cap of the gate and track end respectively, for positive working positioning; the switch beam A and/or B being interlocked to the gate G by a pin and socket engagement 43. The retraction angle of the gate G is to assure release and to avoid jamming. In practice, the end of the switch beam B is recessed at 44 above the rails R, so that the gate need rise but a minimal distance in order to free the switch beam for subsequent movement.

Figure 10:
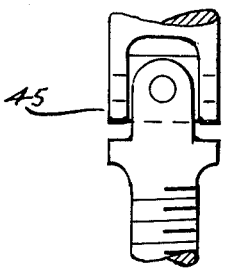

From the foregoing, it will be seen that the switch beams A and B are free to swing upon anti-friction bearing means and that the spacing struts and support shackles are omni-directional at their ball and socket joints, all of which is conducive to complete freedom of the switch beams when released by the gate G. To this end, a motor powered actuator M1 positions the switch beams A and B while a motor powered actuator M2 retracts and replaces the gate G. As shown, the actuators M1 and M2 are mounted to the header H, actuator M1 on a horizontal transverse axis and with a screw engageable through a nut pivoted to one switch beam to shift the two connected switch beams between the operative positions as shown in FIGS. 1 and 2; and actuator M2 on a reclined upwardly and rearwardly disposed axes to shift the gate G. The actuators M1 and M2 have recirculating ball bearings (not shown) engageable with screw members driven through universal joints 45 (see FIG. 10), operation of actuator M1 to either position being dependent upon operation of actuator M2 to the retract position, and operation of actuator M2 to the replacement positioning of gate G being dependent upon operation of actuator M1 into an alignment condition of either switch beam with the continuing track 12. To this end, limit switches control switch beams A and B by detecting the aforementioned positions and/or conditions of and thereby determine operation of the said actuators.

Having described only a typical preferred form and application of my invention, I do not wish to be limited or restricted to the specific details herein set forth, but with to reserve to myself any modifications or variations that may appear to those skilled in the art.

I claim:

1. An articulated self-aligning switch for elevated monorail track, and including; a pair of swinging switch beams with bearing means pivotally mounting the switch beams to the terminal ends of a main line track beam and a lateral track beam respectively, link means coupling the pair of switch beams to swing together and in spaced relation to each other and into and out of alignment with a continuing main line track beam, a retractile gate secured to ways and shiftable into and out of working position between the end faces of either of said pair of swinging switch beams and the end face of the continuing main line track beam, said retractile gate having substantially the same beam cross section with rails for truck support as the aforesaid switch and other track beams thereby to establish track continuity, and means replaceably retracting the gate from said working position to release the switch beams for selective positioning.

2. The switch for elevated monorail track as set forth in claim 1, wherein the end face of the continuing main line track beam is angularly disposed to pass the said terminal end of the lateral track beam.

3. The switch for elevated monorail track as set forth in claim 1, wherein the said ways are upwardly reclined away from the end faces of the swinging switch beams for withdrawal of the retractile gate when out of said working position.

4. The switch for elevated monorail track as set forth in claim 1, wherein the end face of the continuing main line track beam is angularly disposed to pass the said terminal end of the lateral track beam, and wherein the said ways are upwardly reclined thereon away from the end faces of the swinging beams for withdrawal of the retractile gate when out of said working position.

* * * * *